United States Patent [19]

Michelson

[11] 4,232,726

[45] Nov. 11, 1980

[54] PROCESS AND CORE BOX ASSEMBLY FOR HEATLESS PRODUCTION OF HOLLOW ITEMS OF MINERAL GRANULAR MATERIAL

[76] Inventor: Anatol Michelson, 3235 Pine Valley Dr., Sarasota, Fla. 33579

[21] Appl. No.: 22,170

[22] Filed: Mar. 20, 1979

Related U.S. Application Data

[63] Continuation-in-part of Ser. No. 939,660, Sep. 5, 1978, abandoned.

[51] Int. Cl.[3] ..... B22C 9/12

[52] U.S. Cl. ..... 164/12; 164/16; 164/21; 164/165

[58] Field of Search ..... 164/7, 12, 15, 16, 21, 164/160, 253, 254, 255, 165, 166

[56] References Cited

U.S. PATENT DOCUMENTS

| | | | |
|---|---|---|---|
| 2,991,521 | 7/1961 | Bryant et al. | 164/21 |
| 4,068,703 | 1/1978 | Dunlop | 164/160 |

FOREIGN PATENT DOCUMENTS

| | | | |
|---|---|---|---|
| 2457638 | 6/1976 | Fed. Rep. of Germany | 164/16 |
| 48-32054 | 10/1973 | Japan | 164/16 |
| 502143 | 3/1971 | Sweden | 164/16 |

*Primary Examiner*—Robert D. Baldwin
*Assistant Examiner*—K. Y. Lin

[57] ABSTRACT

A process for producing hollow items, for instance foundry cores by reacting a catalyst gas with binder coated on mineral granular material includes providing a core box having a pattern formed of microporous material and investing binder-coated granular material into a volume defined by the pattern. The core box is then sealed so that the volume encloses a gas, for instance air at atmospheric pressure, within the granular material. A catalyst gas is applied at a predetermined pressure through the pattern so that the catalyst gas exerts a uniform pressure from the interior surface of the pattern against the enclosed air volume. The catalyst gas will penetrate a distance through the granular material for curing same determined by an equilibrium condition being reached between the applied catalyst gas pressure and air pressure which results from contraction of the volume.

24 Claims, 12 Drawing Figures

PROCESS AND CORE BOX ASSEMBLY FOR HEATLESS PRODUCTION OF HOLLOW ITEMS OF MINERAL GRANULAR MATERIAL

BACKGROUND AND SUMMARY OF THE INVENTION

This application is a continuation-in-part of applicant's copending application Ser. No. 939,660 filed Sept. 5, 1978, now abandoned.

The present invention relates to a process and core box assembly for producing hollow items of mineral granular material, for instance foundry cores. More particularly, the invention is directed to a novel process and core box assembly which permits heatless production of hollow cores and thin walled molds by reacting a catalyst gas with binder coated on granular material.

The original process for producing shell cores and molds, known as the Croning process, was developed by Dr. Johannes Croning in Germany during World War II. Dr. Croning's process was directed to the use of thermosetting phenol formaldehyde resin in producing a fluidized, hardenable synthetic resin mixture. The Croning process is used today in a process in which sand is precoated with a phenol formaldehyde novalak resin containing hexamethylenetetramine catalyst plus lubricants. The resin changes from a thermoplastic to a thermosetting material under the action of heat in the range of 400°–480° F. The use of heat unfortunately creates significant drawbacks in the Croning process.

For instance, the primary drawback is the substantial use of natural gas as a source of heat. Vast amounts of natural gas energy are used in foundries employing the Croning process, and such use further depletes natural resources. Also, considering the production of shell cores using the Croning process, it is necessary to construct core boxes of high heat resistance. Because temperatures may reach upwardly of 450° F., it is apparent that even substantial core box structures will be subject to relatively short life cycles. In addition, the high temperatures associated with the Croning process create uncomfortable and debilitating conditions for foundry workers. A further significant disadvantage with the Croning process resides in the time necessary for curing. An example of the excessive time required, when compared to that needed in the process of the present invention, will be discussed at a later point.

Other foundry processes in use for producing cores are the no-bake system and the "cold box" process which was first demonstrated in 1968. The cold box process involves mixing sand with two organic resins in liquid form, the first being a phenolic resin and the other a polymeric isocyanate both dissolved in a solvent. Curing of the binder-coated sand is effectuated by passing a catalyst gas through the sand mixture. Such gases may include triethylamine, trimethylethylamine or dimethylethlamine, retained in an inert carrier gas. Another binder system involves using sodium silicate as a sand binder in which curing is effected by passage through the sand mixture of carbon dioxide ($CO_2$) gas. Still another binder system contemplates the use of organic peroxide and a phenolic or furan resin which are hardened by introduction of sulphur dioxide ($SO_2$) gas.

The cold box process as described above is disadvantageous in several important respects. First of all, it can readily be appreciated that during the production of cores, the entire volume defined by the pattern in the core box is filled with sand and hardened. Because cold box processes require hardening of the entire volume of a sand mixture within a core, the cores produced are unnecessarily heavy. For instance, comparing a shell core with a solid core, it can be appreciated that the latter is, on the average, three to four times heavier than a comparably sized shell core. Production of solid cores wastes material and increases production costs. Furthermore, solid cores inherently lack permeability and collapsibility, characteristics which are important in casting.

Accordingly, with the disadvantagee of the Croning and cold box processes in mind, it is a general object of the present invention to provide a novel process for the heatless production of hollow cores by reacting a catalyst gas with binder coated on granular material. More specifically, the process of the present invention is directed to providing a core box having a pattern formed of microporous material and investing binder-coated granular material into a volume defined by the pattern. The core box and the pattern are then sealed so that the volume encloses a gas at rest, for instance, air at atmospheric pressure. Next, a catalyst gas is applied at a pressure greater than atmospheric through the pattern so that the catalyst gas exerts a uniform pressure from the entire interior surface of the pattern against the enclosed air volume. The catalyst gas, due to its being introduced at a higher pressure, will penetrate a distance through the granular material determined by equilibrium being achieved between the applied catalyst gas pressure and a resisting pressure developed by the enclosed air. During penetration of the catalyst gas through the granular material, hardening or curing is effectuated and a hollow core is produced with a thickness determined by the extent of catalyst gas penetration.

It is important to note that an equilibrium condition will be reached between the introduced catalyst gas and the air within the volume due to the principles of Pascal's law and Boyle's law. Specifically, Pascal's law states that pressure applied to an enclosed fluid at rest is transmitted undiminished to every portion of the fluid and the walls of a containing vessel. Boyle's law states that pressure times volume is a constant for a constant mass of gas at a constant temperature. The present invention is directed to an application of Pascal's law and Boyle's law in order to develop, for the first time, a process for the heatless production of a hollow core.

Another object of the present invention is to provide a pattern for use in the process described above which is formed with internal elements which permit complete passage of the catalyst gas through the thickness of the pattern so that the gas will impart pressure against all air molecules existing in spaces between the granular material adjacent the interior surface of the pattern when the pattern is invested with the granular material. More particularly, the pattern may be formed of bonded, substantially spherical elements which define pores dimensioned to permit passage of catalyst gas therethrough while preventing passage of the granular material. It is comtemplated that the substantially spherical elements may be metallic and bonded by means of sintering or alternatively, other forms of material such as ceramics may be employed.

Still another object of the present invention is to provide a core box assembly for use in the process as described above which includes a pair of core box sections each having a pattern section mounted thereon and spaced therefrom. This construction results in a core box having an air space which surrounds the pattern and provides an opening extending into the volume defined by the pattern. The opening (made of nonporous material) is necessary for investing granular material into the pattern prior to application of the catalyst gas and also serves as a discharge port after curing when the core box is rotated approximately 180°. Advantageously, because only a hollow core is produced, uncured sand may be reclaimed.

Still another object of the present invention is to provide a core box assembly in which an ejection mechanism including ejection pins are provided for aiding separation of a cured core from the core box section. More specifically, the ejection pins extend through the pattern and are formed of uniformly microporous material so that the catalyst gas may be permitted to pass therethrough during application of the catalyst gas to the binder coated on the granular material.

Still another object of the present invention is to provide a core box assembly which may produce hollow cores over a selected range of sizes and configurations. This is accomplished by providing a core box assembly which will receive various sized patterns. The patterns are mounted in the core box against spacing members which may be altered for the next sized pattern. The need for a new core box for each pattern is eliminated.

Yet a further object of the present invention is to provide a core box assembly in which the ejection pins are mounted internally of the core box in the air space on a movable member or plate. The ejection pins may be selectively positioned depending upon the size and configuration of pattern used. Because the ejection pins and plate are mounted internally, sealing problems between the air space and the exterior of the core box assembly are substantially eliminated.

These and additional objects and advantages of the present invention will become more readily apparent from a consideration of the following drawings and the detailed description of the preferred embodiment.

DETAILED DESCRIPTION OF THE PREFERRED EMBODIMENT

Figure 1:
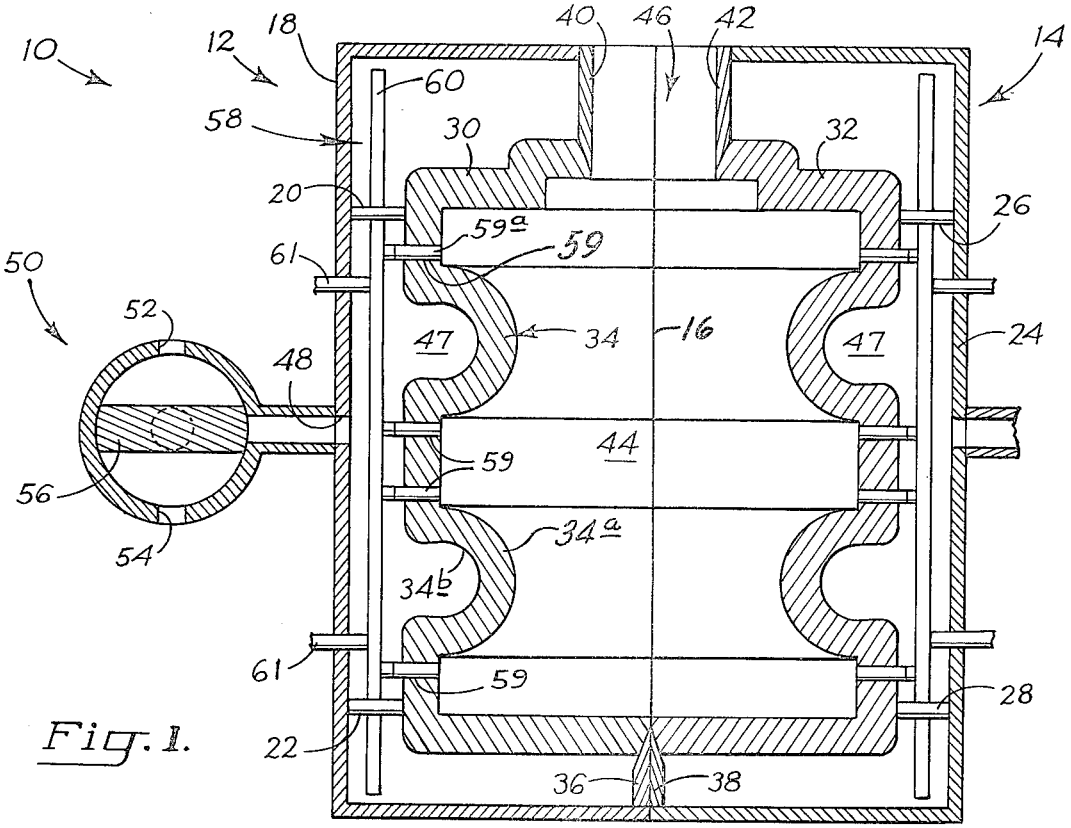
FIG. 1 is a side elevation view taken in cross-section, illustrating a core box assembly according to the present invention having a pattern of uniformly microporous material shaped to produce a ribbed core.

Turning now to the drawings, and referring intially to FIG. 1, a core box assembly for use in the heatless production of hollow cores in accordance witth the present invention is generally indicated at 10. The core box assembly is suitably mounted on a frame structure (not shown) which may include a hopper for holding binder-coated granular material such as a sand mixture and a blower mechanism for forcing the sand mixture into the core box assembly.

As can be seen, the core box assembly includes a pair of core box sections indicated generally at 12, 14 which may be assembled together about a parting line 16. Section 12 includes a wall 18 from which extend a plurality of spacing pins or members 20, 22. Similarly, section 14 includes a wall member 24 from which extend spacing members 26, 28. The spacing members serve to laterally support and fix the orientation of a pattern section mounted in each core box section.

As shown in FIG. 1, a pair of assembled pattern sections 30, 32 define a pattern 34 for producing a ribbed core. The pattern sections are suitably mounted on chamfered plates 36, 38, respectively which extend into appropriate surfaces in the pattern sections along the parting line. Suitable seals (not shown) in the core box assembly extend adjacent the parting line. Extending downwardly from each core box section toward the pattern sections are annular sleeve members such as members 40, 42. When core box assembly 10 is assembled along parting line 16, pattern sections 30, 32 will define an enclosed volume, generally indicated at 44 and annular sleeve members 40, 42 will form a cylindrical sleeve (of nonporous material) which defines an investment opening 46. In addition, it can be seen that an air space, generally indicated at 47 is provided which surrounds the pattern. It is to be emphasized that the core box assembly includes two core box sections which may accommodate pattern sections over a predetermined range of sizes and configurations for producing selected hollow cores.

A port for directing gas into air space 47 is indicated at 48 and is connected to a supply valve, generally indicated at 50, which includes a gas inlet 52 extending to a supply of catalyst gas (not shown) and an outlet 54 extending to an exhaust pump (not shown). A gas member 56 is operable for selectively permitting catalyst gas to be directed through port 48 or to permit evacuation of gas from air space 47 in addition to being positionable in a neutral position, as illustrated. While not shown in FIG. 1, it is contemplated that another catalyst gas supply valve may be provided adjacent wall member 24.

Turning now to specifics of the construction of pattern 34, it can be seen that the pattern, when assembled as shown in FIG. 1, encloses a volume having a peripheral surface defined by an interior surface 34*a* and the volume enclosed by sleeve members 40, 42. Interior surface 34*a* defines the external configuration of a hollow core to be produced. Pattern 34 is formed of microporous material which will permit substantially uniform and continuous passage of catalyst gas through the pattern (in a process to be described) inwardly toward enclosed volume 44 over the entirety of interior surface 34*a*. More particularly, and with reference also directed to FIG. 11, it can be seen that the preferred embodiment of the present invention contemplates that pattern 34 will be formed of a plurality of bonded, substantially spherical elements 35 which define pores dimensioned to permit passage of catalyst gas therethrough while preventing passage of granular material.

For instance, pattern 34 may include spherical elements which are formed by powder metallurgy as in a sintering process. Alternatively, pattern 34 and its associated substantially spherical elements may be formed of ceramic material. The essential features which must be provided to accomplish heatless production of a hollow core is that pattern 34 be formed to permit substantially uniform and continuous passage of catalyst gas over the entire interior surface of the pattern.

Turning to another feature of the present invention, it can be seen that within air space 47 there is provided a separating mechanism or ejection means indicated at 58 for ejecting pattern 34 from its associated core box section. More particularly, a plurality of ejection pins 59 are mounted on a movable ejection plate 60. Each of the ejection pins includes a portion 59*a* formed of uniformly microporous material similar to the microporous material used to form pattern 34. As shown, portions 59*a* extend through pattern 34 and from an exterior surface 34*b* thereof. Actuating members are shown at 61, and extend through wall 18 and are secured to plate 60. The actuating members are operable to displace plate 60 inwardly so that the ends of pins 59 extend inwardly of interior surface 34*b*. By mounting the ejection plate and ejection pins within the air space, air and gas leakage between clearances in the core box assembly walls and the pins is eliminated.

Figure 2:
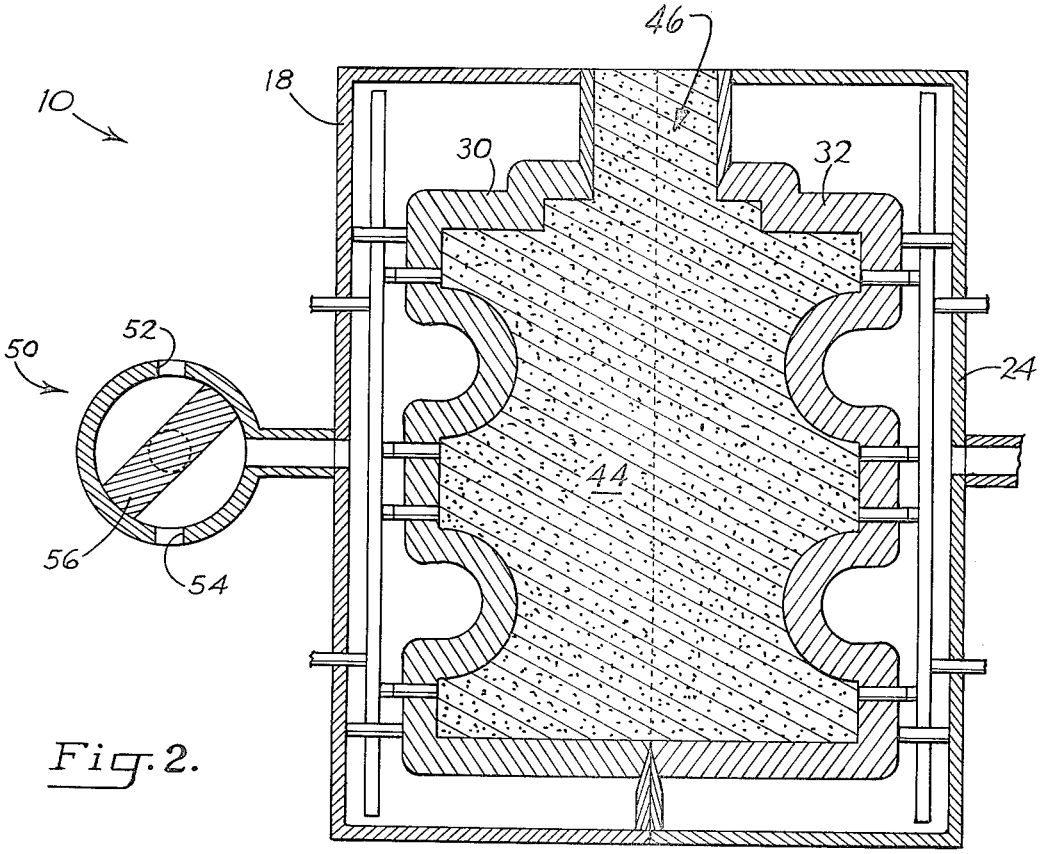
FIG. 2 is a view similar to FIG. 1 and illustrates the first step of the process of the present invention, namely, investment of binder-coated granular material into a volume defined by the pattern.

The process of the present invention using core box assembly 10 in the heatless production of a hollow core will now be described. Core box assembly 10 is suitably mounted in foundry equipment including blower or other means operable for investing granular material, such as binder-coated sand through investment opening 46 to fill enclosed volume 44. Thus, the initial step of the present invention is the investing of sand into enclosed volume 44 while port 48 is permitted to communicate with outlet 54. As sand is invested, air is permitted to be exhausted through port 48 and outlet 54. FIG. 2 illustrates volume 44 filled with sand with air being present in spaces between grains of the sand. The actual mechanism for investing the sand is not shown as such is old in the art.

Figure 3:
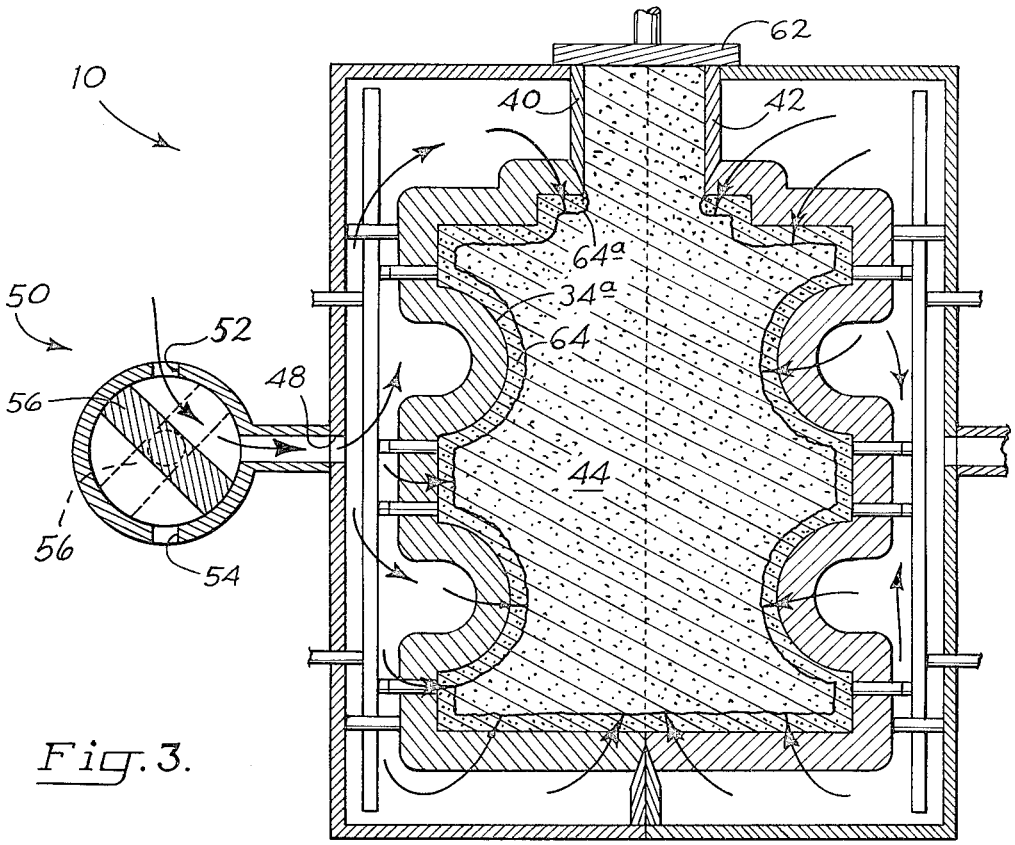
FIG. 3 is a view similar to FIG. 2 and illustrates sealing of the core box assembly by a sealing member and application of a catalyst gas for formation of a hollow core.

The next step is best understood from a consideration of FIG. 3 and illustrates sealing of core box assembly 10 and the enclosed volume by closing investment opening 46 with a sealing member 62 which is selectively operable for covering the investment opening. It is to be understood that enclosed volume 44 encloses a gas at rest, say air at atmospheric pressure within the confines of interior surface 34*a* and the interior surface of sleeve members 40, 42. By opening valve 50 and applying a catalyst gas at a pressure greater than atmospheric through the pattern, the catalyst gas will exert a uniform pressure against the enclosed volume of air and penetrate a distance through the granular material for curing same determined by an equilibrium condition being reached between the applied catalyst gas pressure and a resisting pressure developed within the enclosed volume. The equilibrium condition results in a curing of a hollow core indicated at 64. As shown in FIG. 3, elongate arrows indicate generally the passage of catalyst gas from gas inlet 52 and port 48 through pattern 34 for contact with the binder coated on the granular material.

Figure 8:
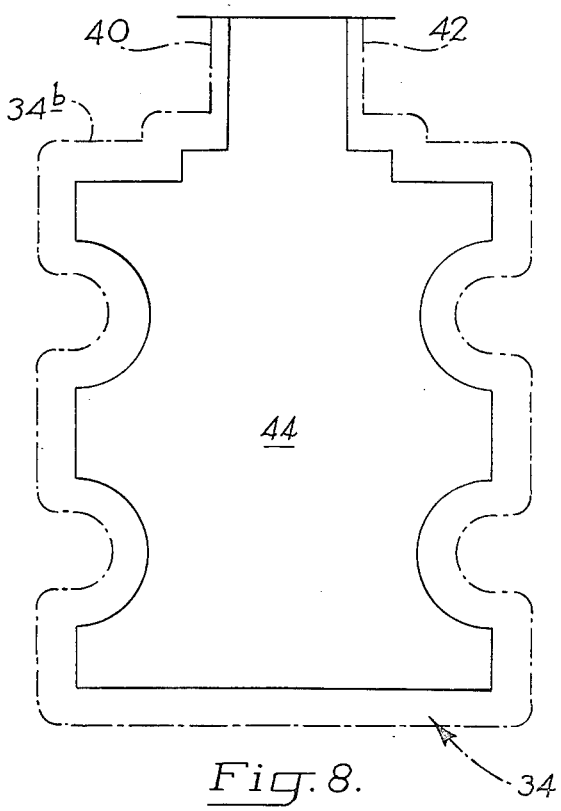
FIG. 8 is a schematic view illustrating the volume of air enclosed by the pattern.
Figure 9:
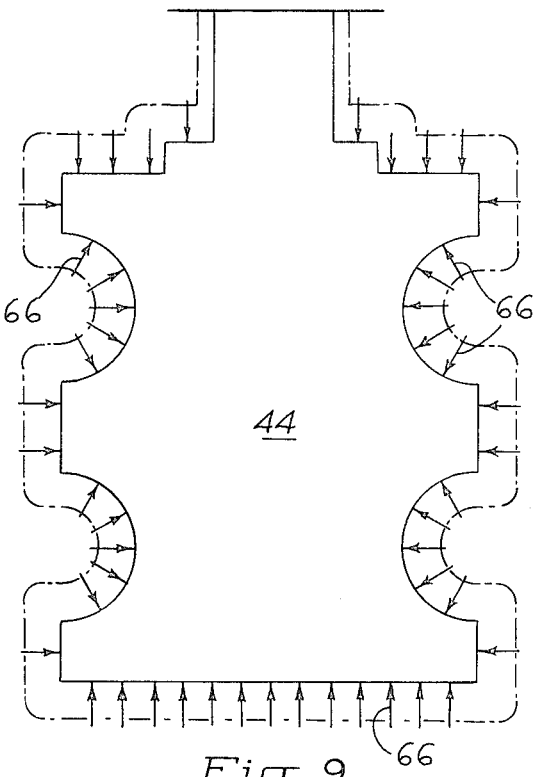
FIG. 9 is a view similar to FIG. 8 illustrating vector lines representing catalyst gas pressure as the catalyst gas pressure uniformly penetrates through the microporous material of the pattern and exerts uniform, undiminished pressure against the enclosed air volume.
Figure 10:
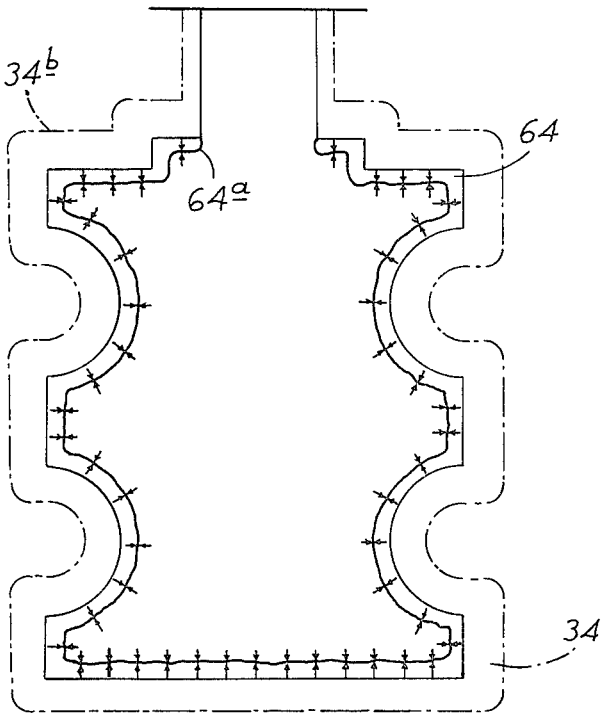
FIG. 10 illustrates an equilibrium condition between the enclosed air volume and the catalyst gas pressure.

In order to completely understand the physical mechanism by which the process of the present invention operates, reference is directed to FIGS. 8–10 which illustrate, at least schematically, the application of Pascal's law and Boyle's law. As stated previously, Pascal's law recites that pressure applied to an enclosed fluid at rest is transmitted undiminished to every portion of the fluid and the walls of the containing vessel. Thus, it can be seen that when sealing member 62 seals core box assembly 10, air, at atmospheric pressure, will be enclosed within the core box and also enclosed within the sand in volume 44 which is defined by the pattern, the interior surfaces of sleeve members 40, 42 and a portion of the bottom of sealing member 62. The enclosed volume of air within the sand is indicated by the solid outline shown in FIG. 8. The dot-dash outline indicates the exterior surface of pattern 34.

Referring now to FIG. 9, there is shown a plurality of vectors at 66. The vectors diagrammatically illustrate uniform application of the catalyst gas to each unit of external surface area of the enclosed volume at a pressure greater than atmospheric. Vectors 66 represent the exact instant when the catalyst gas uniformly penetrates through the pattern from its interior surface for contact with the enclosed air volume. It must be remembered that because the air enclosed within volume 44 is at rest, any increase in pressure, as caused by the application of the catalyst gas, will be transmitted undiminished to every portion of the air enclosed in volume 44. The undiminished transmission or imparting of pressure will cause volume 44 to diminish in volumetric capacity. Therefore, a resisiting pressure will be continuously developed within the volume until an equilibrium condition is reached between the applied catalyst gas and the developed air pressure.

Boyle's law states that pressure times volume remains constant in an enclosed volume if the mass of gas and temperature are constant. Thus, as the capacity of volume 44 is decreased until the equilibrium condition is reached, the catalyst gas will be impeded from further penetration through the granular material. As can be seen from FIG. 10, the catalyst gas is permitted to pass through the granular material some predetermined distance to effectuate curing of the granular material. This curing creates hollow core 64 with a thickness corresponding to the penetration distance of the catalyst gas.

Of course, because sleeve members 40, 42 are made of nonporous material, catalyst gas cannot penetrate therethrough and thus an opening is created at the top of shell core 64 which is indicated at 64*a*. Opening 64*a* is generally present because gas is unable to penetrate entirely across the region of the opening to effectuate curing. However, a slight hardening or curing of granular material across the opening may occasionally result, and this will be dealt with at a later point.

Figure 11:
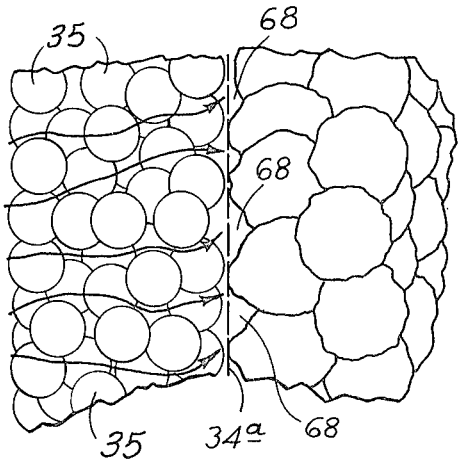
FIG. 11 is a sectional view, greatly enlarged, of the pattern and its interior surface adjacent the granular material and illustrates how the substantially spherical and bonded elements of a microporous pattern permit complete passage of catalyst gas through the pattern so that the gas will impart pressure against all air molecules in spaces existing between the granular material adjacent the interior surface of the pattern.

An important principle of the present invention resides in the fact that pattern 34 is formed of uniformly microporous material. It is necessary to have uniform porosity in order to fully utilize Pascal's law. Stated differently, it is necessary that the pattern be formed to permit complete passage of catalyst gas therethrough so that the catalyst gas will impart uniform pressure against all air molecules in any and all spaces existing between the granular material adjacent the interior surface of the pattern. For instance, as shown in FIG. 11, pattern 34 includes substantially spherical, bonded elements 35 which are provided with pores which permit passage of catalyst gas, indicated by the elongate arrows, to contact all air molecules existing adjacent the interior surface 34*a*. For instance, it can be seen that spaces 68 are present adjacent interior surface 34*a* and when the catalyst gas contacts the air molecules within the spaces, the air molecules will be urged inwardly. If a uniformly porous material was not used for pattern 34, certain air molecules would be bypassed and there would not be even penetration of the catalyst gas through the binder-coated granular material. Adequate reacting of the catalyst gas with the binder to effectuate curing would not occur.

With the above set forth theoretical basis, a return to the process and FIG. 3 is now in order. Considering ejection means 58, it can now be seen why end portion 59*a* of pins 59 must be provided with microporous material. More specifically, upon the application of catalyst gas, it can be seen that the gas will be permitted to pass through end portion 59*a* and be directed inwardly through the granular material to effectuate curing. Because the lengthwise dimension of end portion 59*a* is longer than the thickness of pattern 34, the catalyst gas will be permitted to enter end portion 59*a*, travel along its length, and be directed into the granular material.

Figure 4:
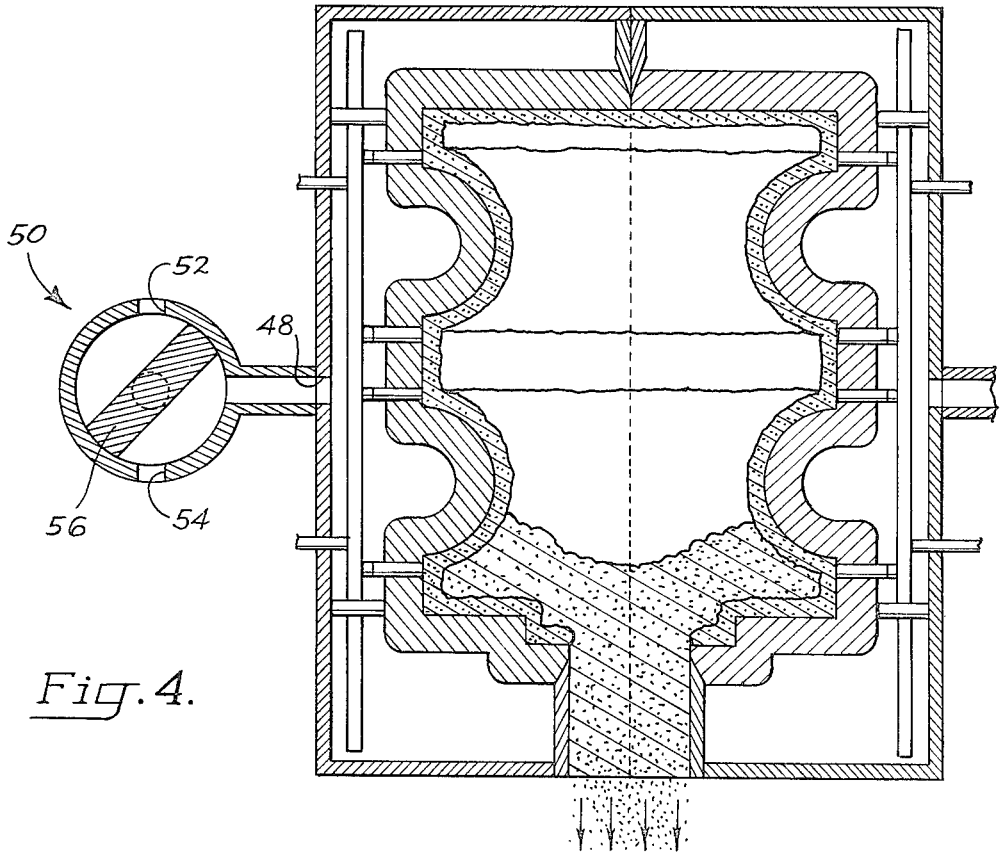
FIG. 4 is a view similar to FIG. 3 and illustrates dumping of uncured granular material after removal of the sealing member and approximately 180° of rotation of the core box assembly.

The next step in the process contemplates that sealing member 62 is removed and valve 50 is operated so that gate member 56 is positioned as shown in dot-dash (FIG. 3) to permit evacuation of any residue catalyst gas through port 48 and outwardly from outlet 54. Evacuation may be caused by suitable actuation of an exhaust fan (not shown) connected to outlet 54 or by supplying compressed air through opening 46. Next, as shown in FIG. 4, the process comtemplates removing uncured granular material from within the pattern volumn. This is accomplished by rotating core box assembly 10 approximately 180° after removal of sealing member 62. It may be necessary to provide some type of scratching mechanism to facilitate discharge of the granular material from the investment opening. More specifically, there may be some hardening across opening 64*a* which will impede downward flow and subsequent discharge of the granular material. By inserting a suitable knife-blade or penetrating device into the opening, partially cured material may be dislodged to permit discharge of the granular material by gravity into a hopper or suitable receiver.

Also, to aid in discharge of granular material, a gas, such as compressed air may be introduced through port 48. The compressed air will help force any retained granular material outwardly through opening 46.

After discharge of the granular material, the ejection pins may be suitably actuated to exert a force against the outer surface of hollow core 64. This force tends to urge hollow core 64 away from pattern 34. However, it may be desired to seal opening 64*a* in core 64 before actuation of the ejection pins. While the opening may be acceptable in some instances, casting requirements may dictate that the core be provided with a continuous exterior surface. Accordingly, in order to close the opening, the present invention comtemplates fusing additional cured granular material to the surfaces surrounding opening 64*a*.

Figure 5:
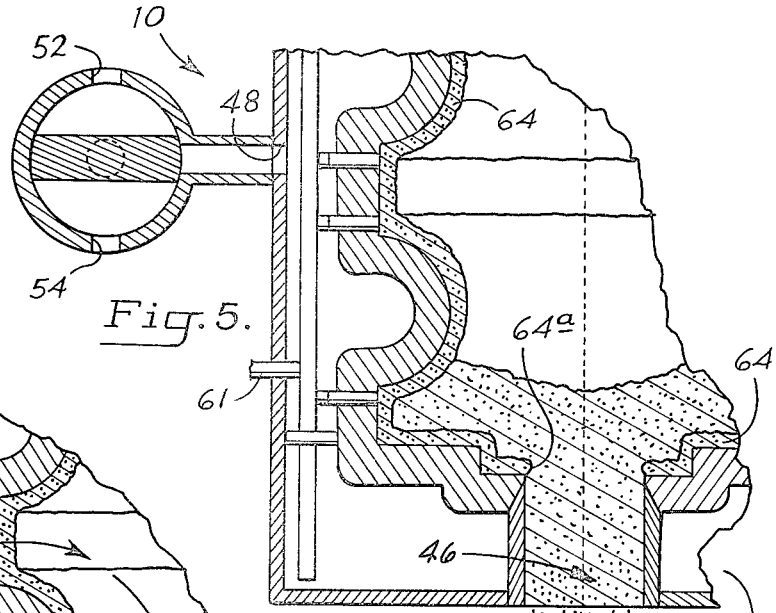
FIG. 5 is a view similar to FIG. 4 illustrating use of a mechanism for returning discharged granular material to the core's opening.
Figure 6:
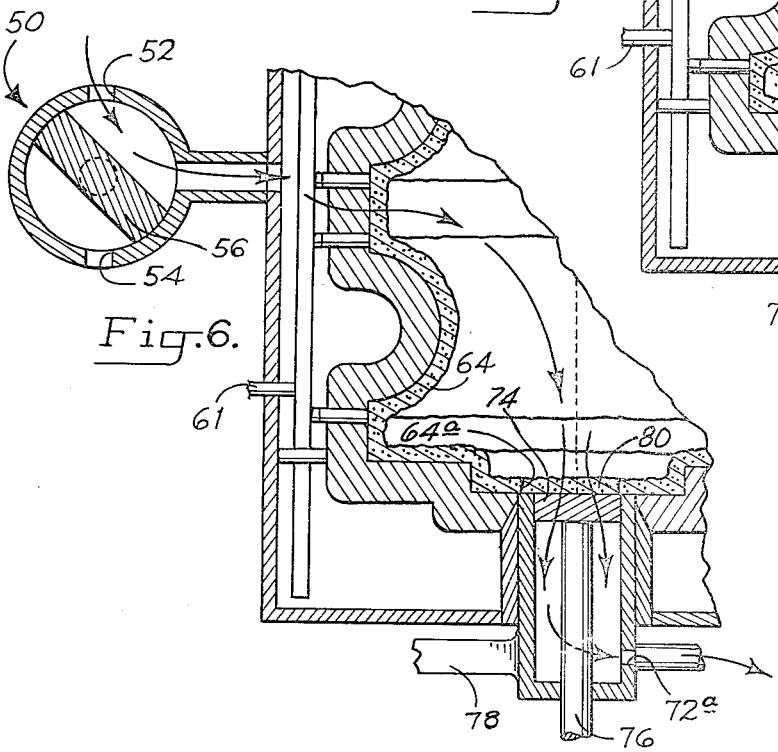
FIG. 6 is a view similar to FIG. 5 illustrating application of catalyst gas to fuse granular material to the opening.

Elaborating further, attention is directed to FIGS. 5 and 6 which illustrate the additional step of returning a portion of the granular material discharged back into the opening of the pattern and reapplying catalyst gas to cure the granular material and fuse it to adjacent wall portions of opening 64*a*. For instance, as shown in FIG. 5, a granular material returning mechanism generally indicated at 70 is provided beneath investment opening 46 during the removal step. Mechanism 70 includes a cylindrical member 72 within which is slidably received a piston 74 (of uniformly microporous material) actuated by a rod 76. Suitable mechanism for actuating the piston and rod assembly is not illustrated. Cylinder 72 may be moved vertically upwardly or downwardly by means of an arm 78 or other means connected to suitable mechanism. As shown in FIG. 5, it is desired to enclose the gap across opening 64*a*, and to this end, during the removal step, a portion of discharged sand is captured within cylinder 72 on top of piston 74 when the piston is retracted. Cylinder 72 is then displaced vertically upwardly (see FIG. 6) so that it slides within the investment opening and is positioned adjacent pattern opening 64*a*. This is the position shown in FIG. 6 and also illustrates movement of rod 76 upwardly so that the granular material retained partially spills out and fills opening 64*a* as indicated at 80. Valve 50 is then actuated with gate member 56 permitting reapplication of catalyst gas through pattern 34 so that it contacts granular material 80 and cures same. This curing will not only harden granular material 80 but will also fuse it to the adjacent side walls of opening 64*a* which previously existed. The catalyst gas passes through the microporous material of piston 74 and outwardly through an outlet 72*a*. Mechanism 70 is then retracted, and residue catalyst gas may be evacuated by appropriate positioning of gate member 56. If deemed necessary, material 80 may be compacted by introduction of compressed air through port 48 prior to application of the catalyst gas.

From the above, it should be appreciated that the process and core box assembly of the present invention utilize existing binders and gaseous catalyst to effectuate curing and provide significant and substantial advantages. Of course, the most significant advantage resides in the fact that, for the first time, a hollow core may be produced in a heatless process by reacting a catalyst gas with binder coated on granular material. Hollow cores may be made of any desired configuration and thickness of the hollow core is dependent upon variable parameters such as catalyst gas strength, application pressure, temperature and duration of gas exposure.

The process of the present invention provides substantial advantages over the Croning process. A main advantage is the elimination of the need for heat which usually is natural gas, thereby conserving precious natural resources. Of course, without the application of heat, working conditions for foundry employees are greatly improved. Additionally, the process of the present invention permits core box construction to be lighter and more durable in that heat resistant materials are not required. The useful life of a core box is not subject to the damaging effects of heat.

Another advantage resides in the fact that granular material need not be hardened throughout the entire volume of a core, as in the cold box process, but rather the bulk of the granular material, invested in the pattern's interior, may be reused for subsequent cores. Savings in sand and binder costs are substantial. In addition, because substantially less sand is used, cores produced by the process in core box assembly of the present invention will be significantly lighter. thereby greatly facilitating handling of the cores.

Still another advantage of the present invention resides in the fact that a single core box assembly may be used for producing hollow cores over a selected range of sizes and configurations. Explaining further, core box assembly 10 contemplates that spacing members 20, 22, etc. (see FIG. 1) may be constructed of different lengths and shapes to readily accommodate various sized patterns. For instance, as shown in FIG. 1, pattern 34 is relatively large and occupies substantial volume within the assembly. It can be readily appreciated that smaller patterns could be selectively mounted in the same core box assembly. Only the pattern and the spacing members need change and the basic components, such as core box sections, 12, 14 may be advantageously utilized for a wide variety of patterns. Of course, by continuously using the same core box assembly, production costs in providing different core boxes are substantially decreased. Storage problems in foundries that have many different sizes core boxes will also be diminished. Also, because the pattern is mounted without any mounting flanges, pattern construction is greatly simplified.

Still another advantage of the present invention resides in the fact that quality hollow cores may be produced if a uniformly microporous pattern is used. There must be complete passage of catalyst gas through the pattern so that the gas will impart pressure against all air molecules in any and all spaces existing between granular material adjacent the interior surface of the pattern. As mentioned, there are materials available which may be produced, either by sintering or other known processes, to provide patterns of any desired configuration. Such patterns will permit uniform and continuous passage of catalyst gas therethrough so that an applied catalyst gas pressure is transmitted undiminished over the surface of the enclosed gas facing the interior surface of the pattern thus ensuring substantially uniform thickness and curing of a hollow core.

In addition, it is necessary to select microporous material for pattern 34 which will not permit granular material to adhere or migrate into the pores of the pattern. Explaining further, it can be seen that if granular material, such as sand, were permitted to enter or at least partially become embedded into pores of pattern 34, a smooth exterior surface of hollow core 64 may not be produced. For instance, after curing, core box sections 12, 14 and their associated patterns 34 are separated from hollow core 64 by actuation of the ejection means. If granular material has become embedded in the pores of pattern 34, adjacent interior surface 34*a* of the pattern, the granular material may become dislodged or pulled away with the pattern thereby causing breaking apart or collapsing of the core or producing a defective surface finish on the core. Additionally, if granular material became embedded in the pores of the pattern, such material will prevent passage of catalyst gas through the pattern. This would result in defective core production.

In order to prevent migration of granular material into pattern 34, as might occur during the investing step, and to also ensure uniform and continuous passage of catalyst gas through the pattern, selection of specific materials for the microporous pattern becomes important. Assuming that granular material such as sand (for instance, Ottawa Foundry Sand) may have optimal dimensions in the range of 70 to 380 microns, it is necessary to provide microporous material for the pattern with pores which will not permit migration or embedding of the sand.

More specifically, it has been determined that microporous materials suitable for use in pattern 34 should have pores dimensioned with spacing in the general range of 5 to 40 microns. For instance, a particularly advantageous microporous material may be formed of bronze powder in either a molded or pressed process. As examples, Thermet Corporation and Pacific Sintered Metals produce bronze powders of the following grades which have been found suitable.

| GRADE | PORE SPACING |
|---|---|
| 103A (Thermet Corp.) | 5–15 microns |
| 83A (Thermet Corp.) | 20–25 microns |
| F60 (Pacific Sintered Metals) | 20–25 microns |
| F100 (Pacific Sintered Metals) | 5–15 microns |

While other metal powders may be used, such as produced by a powder metallurgy process and include stainless steels, chromium, cadmium, etc., it has been found advantageous to use bronze powders because they are relatively inexpensive and may be readily produced, either by molding or pressing, to provide a homogeneous shape.

Nonmetallic materials also may be used for pattern 34 if proper sizing of the pores is provided. As an example, certain grades of ceramic materials, such as manufactured by 3M Company known as "3M Brand Porous Structures" may be used for pattern 34. The following grades, as designated by 3M Company, find particular applicability:

| GRADE | PORE SPACING |
|---|---|
| 15 | 8 microns nominal-<br>15 microns absolute |
| 40 | 20 microns nominal-<br>40 microns absolute |

Thus, while specific microporous materials have been disclosed above, the important consideration in pore spacing in the microporous material is that the spacing be dimensioned to reside generally in the range of 5–40 microns, with an even more preferred range of 5–25 microns. With such ranges, uniform and continuous passage of catalyst gas through the pattern for imparting pressure against all air molecules in any and all spaces existing between granular material adjacent the interior surface of the pattern will be ensured as well as prevention of migration or embedding of the granular material into pores of the pattern.

A further advantage of the present invention resides in the simplicity of the core box assembly construction. Because it contemplates the use of a cold box process, core box assembly 10 may be constructed of an outer wall structure, an inner air space and the pattern. Such a core box assembly is lightweight and may be inexpensively produced.

Still another advantage of the present invention resides in the use of the novel ejection pins having an end portion formed of microporous material. It is apparent that by providing end portions of the ejection pins with microporous material similar to that of the pattern, unimpeded catalyst gas flow will be permitted therethrough so that a region of granular material adjacent the end of the ejection pins will be suitably cured.

Figure 7:
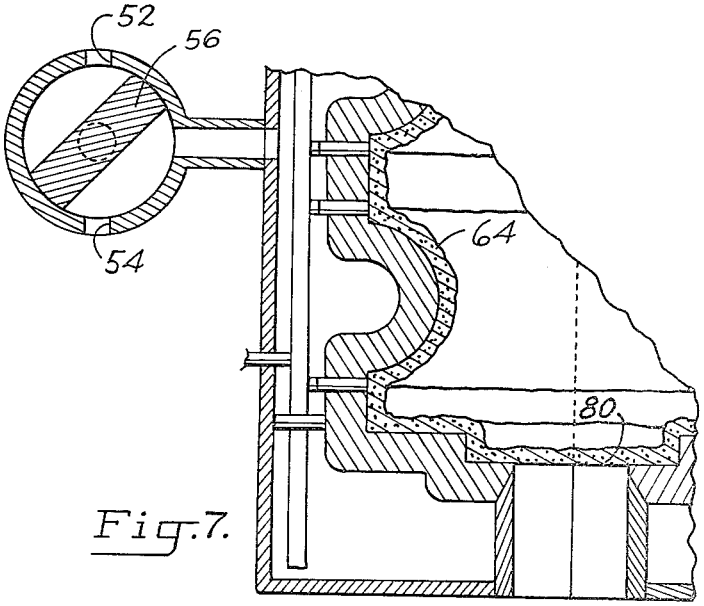
FIG. 7 is a view illustrating the opening as sealed to provide a hollow core having a continuous exterior surface.
Figure 12:
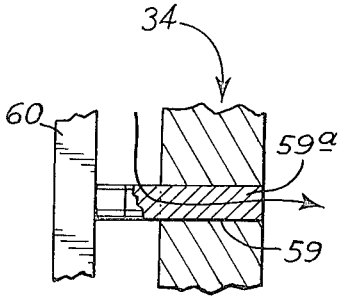
FIG. 12 is an enlarged view of an ejection pin.

A further important advantage in the present invention results in the capability to produce a hollow core having a continuous exterior surface. By returning a portion of the granular material, as outlined in FIGS. 5–7, and reapplying catalyst gas, such as hollow core may be readily produced.

Yet another advantage of the invention results in the decrease in curing time. For instance, it takes several minutes to cure a core in the Croning process, whereas only a fraction of the time is required in the present process. As an example, to make a twenty pound core it takes approximately three minutes of cycle time in the Croning process whereas it has been established that only about thirty seconds are required using the process of the present invention.

While the present invention has been shown and described with reference to the foregoing preferred embodiments, it will be understood by those skilled in the art that other changes in form and detail may be made without departing from the spirit and scope of the invention as defined in the appended claims. For instance, another application of the present invention resides in its suitability for producing thin-walled molds.

It is claimed and desired to secure by Letters Patent:

1. A process for producing a hollow item, such as a foundry core, by reacting a catalyst gas with binder coated on granular material comprising:

providing a core box having a pattern formed of microporous material;

investing binder-coated granular material into a volume defined by said pattern;

sealing said core box and said pattern so that the volume encloses a gas at rest; and applying a catalyst gas at a predetermined pressure through said pattern so that the catalyst gas exerts a uniform pressure from the entire interior surface of said pattern against the enclosed gas volume and penetrates a distance through the granular material for curing same determined by an equilibrium condition being reached between the applied catalyst gas pressure and pressure developed by the enclosed gas, said pattern being formed to permit continuous passage of catalyst gas therethrough so that the catalyst gas will impart pressure against all air molecules existing between granular material adjacent the interior surface of said pattern;

removing uncured granular material from the volume defined by said pattern.

2. The process of claim 1 wherein said core box is provided with a pattern formed of bonded elements which define pores dimensioned with a spacing generally in the range of 5 to 40 microns to permit passage of catalyst gas therethrough while preventing entry of granular material.

3. The process of claim 2 wherein said elements are metallic and are bonded by means of sintering.

4. The process of claim 2 wherein said elements are formed of ceramic material.

5. The process of claim 1 wherein said investing step is accomplished by introducing the granular material through openings provided in the core box and the pattern, said openings having cross-sectional areas smaller than the average cross-sectional area of the enclosed volume, said opening in the core box being defined by walls of nonporous material.

6. The process of claim 1 wherein said sealing step is accomplished by closing said opening in said core box by means of positioning a sealing member to seal said opening.

7. The process of claim 6 further including the step of removing said sealing member and evacuating residue catalyst gas subsequent to said applying step.

8. The process of claim 1 wherein said removing step is accomplished by rotating said core box approximately 180° so that uncured granular material is discharged outwardly from the opening in said core box.

9. The process of claim 1 wherein said removing step is accompanied by introducing a noncatalytic compressed gas into said core box and through said pattern and hollow core to dislodge residue granular material.

10. The process of claim 8 further including the step of forming the hollow core with a continuous exterior surface by returning a portion of granular material into the opening of said pattern and the opening of the hollow core and reapplying catalyst gas to cure the granular material and fuse it to adjacent walls of the opening of the hollow core.

11. The process of claim 1 wherein ejection pin means formed of microporous material extend into said pattern providing a passage for catalyst gas therethrough and into the granular material during said applying step.

12. The process of claim 1 wherein said sealing step includes sealing said core box and said pattern so that the volume encloses air at atmospheric pressure.

13. The process of claim 1 wherein penetration distance of the catalyst gas is predetermined by preselecting catalyst gas temperature, pressure and strength, said penetration distance also being predetermined by preselecting duration of catalyst gas application.

14. A core box assembly for use in producing a hollow item, such as a foundry core, by reacting a catalyst gas with binder coated on granular material comprising:

a pair of core box sections each including a pattern section mounted thereon and spaced therefrom so that when said core box sections and their respective patterns are assembled along a parting line, an air space is provided which surrounds the pattern and an opening extends into the volume defined by the pattern for receiving granular material;

a gas-tight sealing member is provided at said opening for sealing said space after the granular material is introduced;

a port provided in at least one of said core box sections for permitting introduction of a catalyst gas into the air space; and said pattern being formed of microporous material which permits substantially uniform and continuous passage of the catalyst gas through the pattern and inwardly toward the hollow volume over the entire interior surface of said pattern.

15. The core box assembly of claim 14 wherein said pattern is formed to permit uniform passage of catalyst gas through the pattern and from its interior surface so that the catalyst gas will impart pressure against all air molecules existing between the granular material adjacent the interior surface of said pattern when the volume defined by said pattern is invested with granular material.

16. The core box assembly of claim 15 wherein said pattern is formed of bonded elements which define pores dimensioned with a spacing generally in the range of 5 to 40 microns to permit passage of catalyst gas therethrough while preventing entry of granular material.

17. The core box assembly of claim 16 wherein said elements are metallic and are bonded by means of sintering.

18. The core box assembly of claim 16 wherein said elements are formed of ceramic material.

19. The core box assembly of claim 14 wherein spacing members are interposed between each core box section and its associated pattern to fix the orientation therebetween.

20. The core box assembly of claim 14 wherein the opening extending into the hollow volume is formed of nonporous material.

21. The core box assembly of claim 14 wherein at least one of said core box sections is provided with ejection pin means extending through said pattern operable for inward movement beyond the interior surface of said pattern, said ejection pin means including a portion formed of uniformly microporous material so that catalyst gas is permitted to pass therethrough.

22. The core box assembly of claim 21 further including ejection pin means formed of microporous material over a length dimensioned greater than the thickness of said pattern.

23. The core box assembly of claim 14 wherein said core box sections are adapted to receive pattern sections over a preselected range of sizes and configurations.

24. The core box assembly of claim 14 wherein said pattern sections are formed with a configuration necessary only for formation of a hollow core.

* * * * *